United States Patent [19]

Caraher

[11] 4,396,853

[45] Aug. 2, 1983

[54] OXYGENATED PHOTOSENSITIVE SCREEN

[75] Inventor: James R. Caraher, Stamford, Conn.

[73] Assignee: The Machlett Laboratories, Incorporated, Stamford, Conn.

[21] Appl. No.: 179,190

[22] Filed: Aug. 18, 1980

Related U.S. Application Data

[60] Continuation of Ser. No. 898,008, Apr. 20, 1978, which is a division of Ser. No. 784,207, Apr. 4, 1977, Pat. No. 4,147,950.

[51] Int. Cl.[3] ..... H01J 40/00

[52] U.S. Cl. ..... 313/527

[58] Field of Search ..... 313/101, 386, 94, 101, 313/102, 375; 427/70

[56] References Cited

U.S. PATENT DOCUMENTS

| | | | |
|---|---|---|---|
| 3,147,226 | 9/1964 | Jonck | 250/483 X |
| 3,617,743 | 11/1971 | Rabatin et al. | 250/213 VT |
| 3,855,035 | 12/1974 | Bates et al. | 156/306 |
| 4,069,355 | 1/1978 | Lubowski et al. | 250/483 X |
| 4,147,950 | 4/1979 | Caraher et al. | 313/180 |

FOREIGN PATENT DOCUMENTS

| | | | |
|---|---|---|---|
| 1398976 | 6/1975 | United Kingdom | 427/74 |

*Primary Examiner*—Alfred E. Smith
*Assistant Examiner*—Ken Wieder
*Attorney, Agent, or Firm*—John T. Meaney; Joseph D. Pannone

[57] ABSTRACT

An image intensifier tube comprising a sealed envelope having therein means for controllably liberating oxygen within the envelope, and an input screen including an oxygen conditioned layer of fluorescent material and an overlying layer of photoemissive material which may be oxidized to improve the photon-to-electron conversion efficiency of the input screen.

A method of improving the conversion efficiency of an image intensifier tube input screen including the steps of exposing a layer of fluorescent material to oxygen prior to the deposition of an overlying layer of photoemissive material, and subsequently exposing the layer of photoemissive material to oxygen, if desired, after the tube envelope has been sealed.

8 Claims, 7 Drawing Figures

FIG. 6
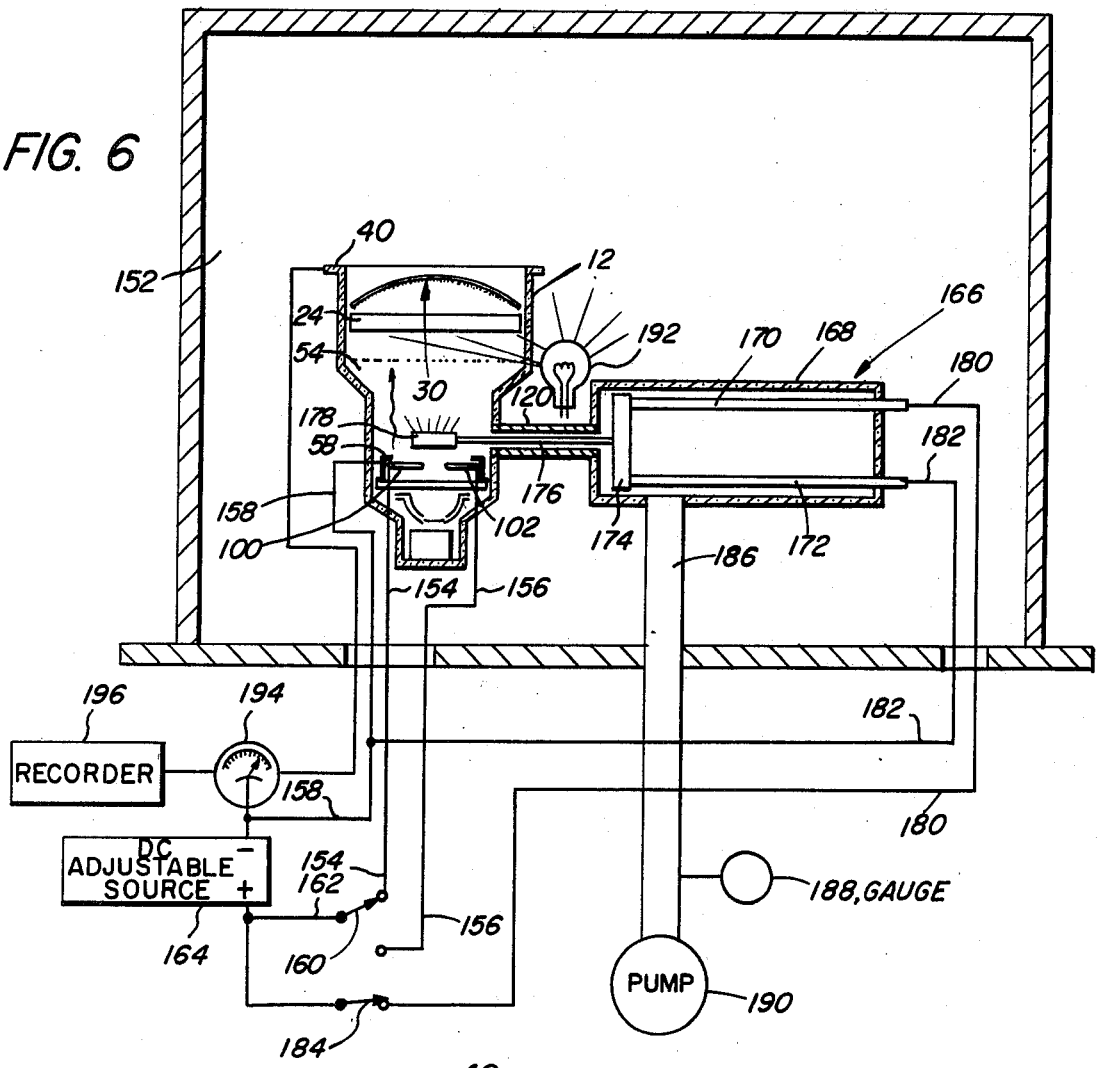
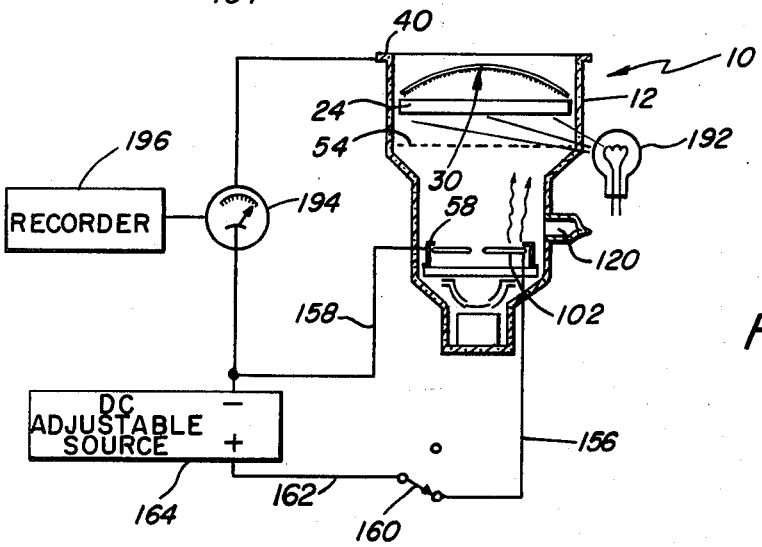
FIG. 7

OXYGENATED PHOTOSENSITIVE SCREEN

CROSS-REFERENCE TO RELATED CASES

This is a continuation of application Ser. No. 898,008, filed Apr. 20, 1978 which is a divisional of Ser. No. 784,207, filed Apr. 4, 1977, now U.S. Pat. No. 4,147,950 issued on Apr. 3, 1979.

BACKGROUND OF THE INVENTION

1. Field of the Invention

This invention relates generally to light amplifier tubes and is concerned more particularly with means for enhancing the photon-to-electron conversion efficiency of image intensifier tube input screens.

2. Discussion of the Prior Art

Generally, an image intensifier tube comprises a tubular envelope closed at one end by a radiation transmissive faceplate having an input screen disposed adjacent the inner surface thereof. The input screen may include a scintillator layer of radiation sensitive material aligned with the faceplate and supporting on its inner surface a substantially coextensive layer of photoemissive material. In operation, a radiational image impinging on the scintillator layer causes it to fluoresce locally in accordance with the spatial distribution of photons in the image. As a result, the photoemissive layer emits an equivalent electron image which may be amplified to produce a corresponding bright visible image. Thus, the brightness of the visible image may be enhanced by increasing the photon-to-electron conversion efficiency of the input screen.

One method known in the prior art for improving the conversion efficiency of the input screen includes the processing step of oxidizing the vacuum interface surface of the photoemissive layer to obtain a peak value of conversion efficiency. Accordingly, the tube may be connected to an exhaust system having therein an oxygen source disposed to release a desired quantity of oxygen into the tube envelope after deposition of the input screen photoemissive layer. As a result, the released oxygen migrates to the exposed inner surface of the photoemissive layer and oxidizes the the material thereof. Subsequently, the tube is sealed-off from the exhaust system, and is submitted to final test. During final test, it may be found that the photoemissive layer of the input screen has not been oxidized sufficiently to provide the peak value of conversion efficiency. However, since the tube is sealed-off from the source of oxygen, the material of the photoemissive layer cannot be oxidized to increase the conversion efficiency of the input screen.

Therefore, it is advantageous and desirable to provide method and means for enhancing the photon-to-electron conversion efficiency of an image intensifier tube input screen, even after the tube envelope has been sealed.

SUMMARY OF THE INVENTION

Accordingly, this invention provides an image intensifier tube comprising a sealed envelope having therein controllable oxygen liberating means for releasing oxygen within the envelope when desired. The oxygen liberating means includes a source of oxygen, such as manganese dioxide, for example, disposed within the envelope for activation by controllable means, such as electrical heating, for example. Alternatively, the oxygen source may comprise a halogen oxide, such as $KClO_3$, $KBrO_3$, or $KClO_4$, for examples, or any other material suitable for controllably releasing oxygen within the envelope when activated.

Preferably, the image intensifier tube comprises a tubular envelope having one end closed by a radiation transmissive input faceplate and the other end closed by a transparent output faceplate. An input screen is disposed adjacent the inner surface of the input faceplate to receive an incoming radiational image and emit an equivalent electron image. Disposed adjacent the inner surface of the output faceplate is an output screen for converting the electron image into a corresponding visible image viewable through the output faceplate of the tube. An intermediate series of coaxially aligned electrodes is disposed between the input screen and the output screen for electrostatically accelerating the electron image emitted from the input screen and focusing it onto the output screen. The oxygen source may be suitably supported by one of the intermediate electrodes and connected to terminal means of the tube for electrically heating the source to a predetermined oxygen liberating temperature range. Alternatively, the oxygen source may be supported by another component part of the tube, and may be heated by other controllable means, such as an electrical induction coil, for example.

The input screen includes a scintillator layer of fluorescent material aligned with the input faceplate and supporting on its inner surface a photocathode layer of photoemissive material, such as cesium antimonide, for example. The input screen further may include a thin supporting substrate disposed adjacent the inner surface of the input faceplate and made of radiation transmissive material, such as aluminum, for example, which also is light reflective. Thus, the substrate permits an incoming radiational image to impinge on the scintillator layer and produce fluorescent light, which then is reflected by the substrate toward the photocathode layer to enhance the emission of an equivalent electron image therefrom.

The scintillator layer preferably comprises juxtaposed crystalline rods of doped alkali-halide material, such as cesium iodide doped with sodium or thallium, for example. The crystalline rods are disposed substantially perpendicular to the supporting substrate and are microscopically spaced from adjacent rods to inhibit cross-talk or lateral diffusion of the light produced therein. Consequently, each of the rods functions as a respective light pipe to promote longitudinal transmission of the fluorescent light generated therein toward an aligned portion of the photocathode layer, thereby enhancing the contrast characteristics of the output visible image.

In accordance with the method of this invention, the oxygen source is activated to oxygenate or treat the fluorescent material of the scintillator layer with oxygen prior to the deposition of the photocathode layer. After the photoemissive material of the photocathode layer is deposited on the inner surface of the oxygenated fluorescent material of the scintillator layer, processing of the tube is completed; and the tube envelope is sealed-off. Subsequently, it may be found that the photoemissive material of the photocathode layer is not achieving peak conversion efficiency in producing the equivalent electron image. Then, the oxygen source may be re-activated to oxidize the photoemissive material in a controlled manner until peak conversion efficiency of the photocathode layer is obtained.

BRIEF DESCRIPTION OF THE DRAWINGS

For a better understanding of this invention, reference is made in the following detailed description to the accompanying drawings wherein:

FIG. 6 is a schematic view showing the processing step of depositing the photoemissive material of the photocathode layer on the inner surface of the scintillator layer; and FIG. 7 is a schematic view showing the processing step of oxidizing the photoemissive material of the photocathode layer.

DESCRIPTION OF THE PREFERRED EMBODIMENT

Figure 1:
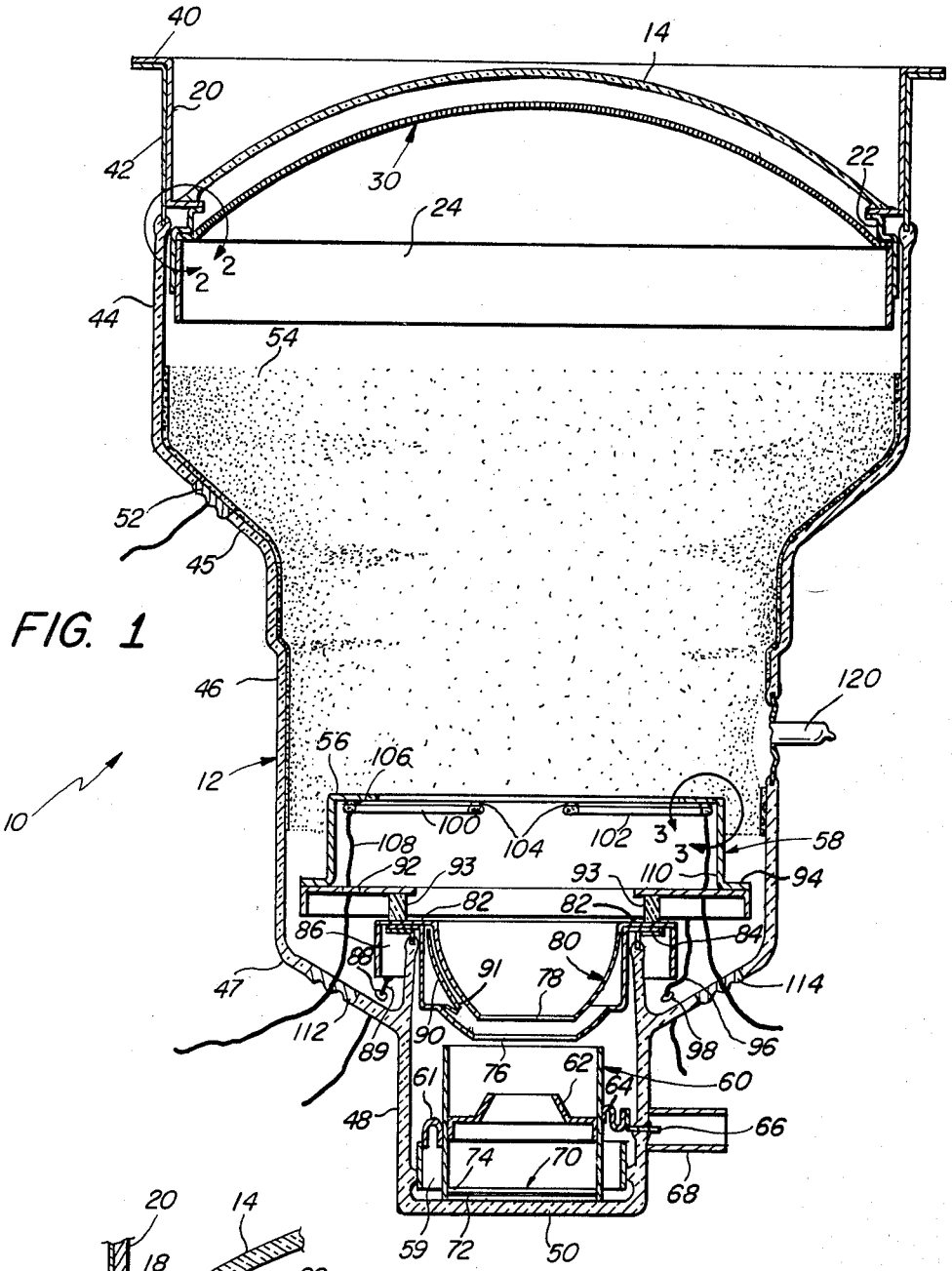
FIG. 1 is an axial sectional view of an image intensifier tube embodying the invention.

Referring to the drawings wherein like characters of reference designate like parts throughout the several views, there is shown in FIG. 1 an image intensifier tube 10 comprising a tubular envelope 12 closed at one end by an input faceplate 14. The input faceplate 14 is made of radiation transmissive material, such as lead-free glass, for example, and may be provided with a dome-like configuration having a convex outer surface and a concave inner surface. Alternatively, the input faceplate 14 may be made of juxtaposed optical fibers, and may be provided with any other suitable configuration, such as plano-concave, for example.

Figure 2:
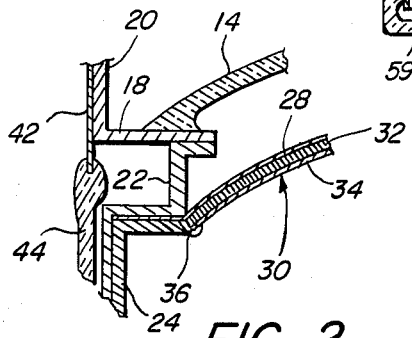
FIG. 2 is an enlarged fragmentary view of the input end portion of the tube shown in FIG. 1.

As shown more clearly in FIG. 2, the input faceplate 14 is peripherally sealed to one surface of an inwardly extended end portion 18 of a collar 20 made of electrically conductive material, such as Kovar, for example. The opposing surface of end portion 18 is attached to a flanged end portion of a stepped support annulus 22 made of electrically conductive material, such as aluminum, for example. The other end portion of support annulus 22 extends longitudinally of envelope 12 and is attached to an encircled ring 24 made of electrically conductive material, such as aluminum, for example. Clamped between an intermediate shoulder portion of support annulus 22 and a flanged rim of ring 24 is a peripheral portion of a thin dome-like substrate 28 having a curvature which conforms substantially to the curvature of input faceplate 14. The substrate 28 is made of radiation transmissive material which also is electrically conductive and light reflective, such as aluminum, for example, and has an inner concave surface supporting an input screen 30 substantially in axial alignment with the input faceplate 14. Alternatively, the input screen 30 may be supported on the inner concave surface of the input faceplate 14, which may require an interposed radiation transmissive layer (not shown) of mutually compatible material, such as aluminum, for example.

The input screen 30 comprises a scintillator layer 32 of radiation sensitive material which preferably is oxygenated, that is treated with oxygen, and an overlying photocathode layer 34 of photoemissive material, which may be oxidized. The scintillator layer 32 fluoresces locally in accordance with the spatial distribution of photon energy in an incident radiational image. Accordingly, the scintillator layer 32 may comprise doped alkali-halide material, such as cesium iodide doped with sodium or thallium, for example, which is highly efficient for use in investigative systems employing common radiational sources, such as X-rays and Gamma rays, for examples. The doped cesium iodide fluorescent material may be deposited, as by vapor deposition, for example, on the inner concave surface of substrate 28 as juxtaposed crystalline needles or rods which are substantially perpendicular to the substrate and are microscopically spaced from one another. Thus, each of the crystalline rods functions as a respective light pipe means for inhibiting crosstalk or lateral diffusion of the fluorescent light generated therein and promoting longitudinal transmission of the light to an aligned region of the photocathode layer 34. The doped cesium iodide material of the rods may be oxygenated by exposing the scintillator layer 32 to oxygen gas prior to deposition of photocathode layer 34.

The photocathode layer 34 generally comprises a light sensitive photoemissive material, such as cesium antimonide, which may be deposited by conventional means, such as vapor deposition, for example, on the inner surface of scintillator layer 32. Discrete regions of the deposited photoemissive material emit electrons in accordance with the intensity of incident light photons generated in aligned regions of the scintillator layer 32. Thus, in response to an impinging radiational image, the scintillator layer 32 produces a corresponding fluorescent light image which causes the photocathode layer 34 to emit from the inner concave surface thereof an equivalent electron image. Accordingly, the photon-to-electron conversion efficiency of the photocathode layer 34 may be determined by directing a predetermined intensity of light photon energy onto the photoemissive material of layer 34 and measuring the resulting emitted electron current. Since oxidation of the photoemissive material may be required to improve the photon-to-electron conversion efficiency, the photocathode layer 34, alternatively, may comprise an oxidized photoemissive material, such as cesium antimony oxide, for example.

An annular marginal portion of the photocathode layer 34 and the periphery of scintillator layer 32 may be provided with a plating 36 of electrically conductive material, such as aluminum, for example. The plating 36 extends onto the adjacent peripheral portion of substrate 28 and electrically connects the photocathode 34 through the support annulus 22 to the adjacent end portion of conductive collar 20. The other end portion of collar 20 terminates in an outwardly extended annular flange 40, which constitutes the cathode terminal of tube 10 and provides means for maintaining the photocathode layer 34 at a desired electrical potential.

The flange 40 is hermetically attached to a flanged end portion of a cathode sleeve 42 which closely encircles the collar 20 and is made of suitable material, such as Kovar, for example. The other end portion of sleeve 42 is sealed to one end of a large diameter envelope portion 44 made of dielectric vitreous material, such as glass, for example. The other end of large diameter portion 44 is integrally joined to an outer periphery of a first inwardly flared, envelope portion 45 which has an inner periphery integrally joined to one end of an intermediate diameter, envelope portion 46. The first inwardly flared portion 45 of envelope 12 may have sealed therein a first grid, button-type terminal 52 which is electrically connected within envelope 12 to an axially extending, first grid electrode 54. Electrode 54 comprises a hollow cylinder made of electrically conductive material, such as aluminum, for example, which may conveniently be deposited in a thin layer on the inner cylindrical surfaces of large diameter portion 44, inwardly flared portion 45, and intermediate portion 46 of envelope 12. The first grid electrode 54 has one end disposed adjacent the ring 24, and an opposing end insulatingly encircling an inwardly extended flange 56 at one end of stepped ring 58 which comprises the second grid electrode of tube 10.

The other end of intermediate diameter envelope portion 46 is integrally joined to an outer periphery of a second inwardly flared, envelope portion 47, which has an inner periphery sealed to an exterior cylindrical surface of a small diameter, tubular portion 48 of envelope 12. One end of small diameter portion 48 is integrally joined to an outer peripheral portion of a transversely disposed output faceplate 50, which closes the other end of envelope 12. Supported on the inner cylindrical surface of small diameter envelope portion 48 is a ring 59 made of suitable material, such as Kovar, for example. The ring 59 encircles an axially disposed anode sleeve 60 having one end abutting the inner surface of output faceplate 50 and having an opposing open end. The outer cylindrical surface of anode sleeve 60 may have attached thereto a circular array of spaced, loop springs 61 which engage respective slots in the ring 59 to maintain the sleeve 60 in axial alignment with output faceplate 50.

Between the opposing ends of anode sleeve 60, there may be attached to the inner cylindrical surface thereof an axially disposed, focusing annulus 62 made of electrically conductive material, such as stainless steel, for example. The focusing annulus 62 preferably is provided with a frusto-conical configuration having an open end directed toward the output faceplate 50 and an opposing open end of smaller diameter. The outer cylindrical surface of anode sleeve 60 is electrically connected through a flexible conductor 64 to an anode terminal 66 sealed in the wall of small diameter envelope portion 48. The anode terminal 66 has an externally extended portion which may be encircled by a protective tubulation 68 made of dielectric vitreous material, such as glass, for example, which is supported on the outer surface of envelope 12. Thus, the anode terminal 66 provides means for maintaining the anode sleeve 60 and connected conductive components of tube 10 at a desired electrical potential.

The end portion of anode sleeve 60 abutting the inner surface of output faceplate 50 supports in axially aligned relationship therewith a transversely disposed, output screen 70. Output screen 70 comprises a phosphor layer 72 disposed adjacent the output faceplate 50 and an overlying layer 74. The phosphor layer 72 comprises a material sensitive to impinging electrons, such as silver activated zinc cadmium sulfide, for example, which fluoresces locally in accordance with the spatial distribution of energy in an incident electron image. The overlying layer 74 is made of an electron transmissive material, such as a relatively thin layer of aluminum, for example, which also is light reflective and electrically conductive. A peripheral portion of layer 74 is disposed in electrical contact with the anode sleeve 60, whereby the output screen 70 may be maintained at a high positive potential with respect to the input screen 30. As a result, the electron image emitted from the photocathode layer 34 is electrostatically accelerated toward the output screen 70 with sufficient energy to pass through the layer 74 and impinge on the underlying phosphor layer 72. Consequently, the phosphor layer 72 produces a correspondingly bright visible light image which is viewable through the output faceplate 50.

The opposing open end of anode sleeve 60 is disposed adjacent an aligned, smaller diameter aperture 76, which is aligned with an axially spaced aperture 78 of similar diametric size. The apertures 76 and 78 are disposed in inwardly curved portions of outer and inner walls, respectively, of a generally bowl-shaped electrode 80, which has an opposing open end of relatively large diameter. The electrode 80 is made of electrically conductive material, such as stainless steel, for example, and comprises the third grid electrode of tube 10. At the larger diameter, open end of electrode 80, the respective outer and inner walls thereof merge and extend outwardly to form an annular rim portion 82, which is attached to an underlying flange 84. The flange 84 is sealed to an adjacent end of small diameter tubular portion 48, which extends longitudinally within the envelope 12. The glass-to-metal seal between flange 84 and small diameter portion 48 is shielded by an annular skirt 86 attached to the rim portion 82 of electrode 80. Sealed in the adjacent flared portion 47 of envelope 12 is a third grid terminal button 88 which is connected through a conductor 89 to the skirt 86 and, consequently, to the third grid electrode 80.

During processing of the input screen 30, there may be disposed between the similar size apertures 76 and 78, respectively, a dish-shaped, shutter disc 90 of slightly larger diameter which shields the output screen 70 from contamination. After processing is completed, the tube 10 may be tipped in a suitable direction for sliding the disc 90 up between the outer and inner walls of electrode 80, where it may be captured by resilient tang means 91 attached to an adjacent wall surface of electrode 80. Thus, during subsequent operation of tube 10 the respective apertures 76 and 78 are disposed in aligned communication with one another to permit passage of a convergent electron image into anode sleeve 60. The convergent electron image optically crosses over adjacent the entrance end of focusing annulus 62 and emerges therefrom as an enlarging inverted image. Accordingly, the electron image is electrostatically focused onto the output screen 70 by inverting it with respect to the radiational image incident on input screen 30. However, although an image intensifier tube of the inverted focusing type is described herein for purposes of illustration, it is to be understood that this invention also is applicable to other types of light amplifier tubes, such as image intensifier tubes of the proximity focusing type, for example.

Rim portion 82 of third grid electrode 80 has attached thereto respective ends of annularly spaced posts 93 which extend longitudinally of tube 10 and are made of dielectric material, such as ceramic, for example. The posts 93 have respective opposing ends attached by conventional means to an inner peripheral portion of a transversely disposed, annular plate 92 made of conductive material, such as stainless steel, for example. Annular plate 92 defines a central aperture which is aligned with the adjacent entrance aperture of third grid electrode 80 and has a larger diameter. The plate 92 extends radially outward and has an outer peripheral portion attached to a shouldered end portion 94 of second grid electrode 58. The shouldered end portion 94 is electrically connected through a conductor 96 to a terminal button 98 sealed in the flared portion 47 of envelope 12. Thus, the first, second, and third grid electrodes, 54, 58, and 80, respectively, are connected to respective electrical terminal means for maintaining them at suitable electrical potentials to accelerate and focus the electron image emitted from input screen 30 onto output screen 70.

The flange 56 at the other end of second grid electrode 58 defines an axially disposed aperture which is aligned with the aperture defined by plate 92 and has a larger diameter. Underlying the flange 56 is a plurality of arcuate channel members, such as 100 and 102, for example, which have respective end portions electrically attached to the flange 56 by conductive support posts 104. Respective other end portions of the channel members 100 and 102 are insulatingly attached to flange 56 by dielectric posts 106 and are electrically connected through respective conductors 108 and 110 to terminal buttons 112 and 114, respectively, sealed in the flared portion 47 of envelope 12. Adjacent the flange 56 of second grid electrode 58, there is sealed in the encircling wall of intermediate diameter envelope portion 46 an exhaust tubulation 120 made of a material, such as copper, for example, which may be hermetically sealed-off, as by crimping, for example.

Figure 3:
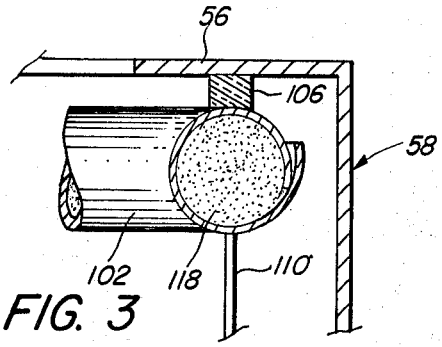
FIG. 3 is an enlarged fragmentary view of the oxygen liberating means in the image intensifier tube shown in FIG. 1.

As shown more clearly in FIG. 3, each of the arcuate channel members 100 and 102 underlying flange 56 may comprise a hollow tubing made of electrically conductive material, such as stainless steel, for example. The tubings of channel members 100 and 102 have respective closed ends and longitudinal edge portions which overlap to provide egressing means for gaseous vapors generated therein. Preferably, the overlapping longitudinal edges of channel members 100 and 102, respectively, are disposed to deflect the egressing gaseous vapors off the adjacent wall surfaces of second grid electrode 58 prior to migrating toward the input screen 30. The tubing of channel member 102 may be filled with a cesium liberating powder material, such as cesium chromate, for example, and is electrically heated by way of button terminal 112 and conductor 108 to cause vaporization of the cesium material during deposition of the photocathode layer 34.

The tubing of channel member 102 is filled with a source 118 of oxygen, such as manganese dioxide powder material, for example, and is heated electrically by way of terminal button 114 and conductor 110 to cause a gaseous vapor to be released from the source 118 during processing of the input screen 30. The source 118 of oxygen in channel member 102 connected through conductor 110 to terminal 114 comprises a means for controllably liberating oxygen within envelope 12 even after it is sealed. Alternatively, the source 118 of oxygen may comprise a halogen oxide material, such as potassium chlorotrioxide, potassium bromotrioxide, or potassium chlorotetroxide, for examples, or any other material suitable for controllably releasing oxygen within envelope 12, when activated. Also, any desired number of channel members having respective oxygen sources therein may be provided within envelope 12, and may be suitably supported on other component parts of tube 10. Furthermore, channel member 102 may have any desired configuration, and may be heated by other than the described means, such as induction type heating, for example.

Figure 4:
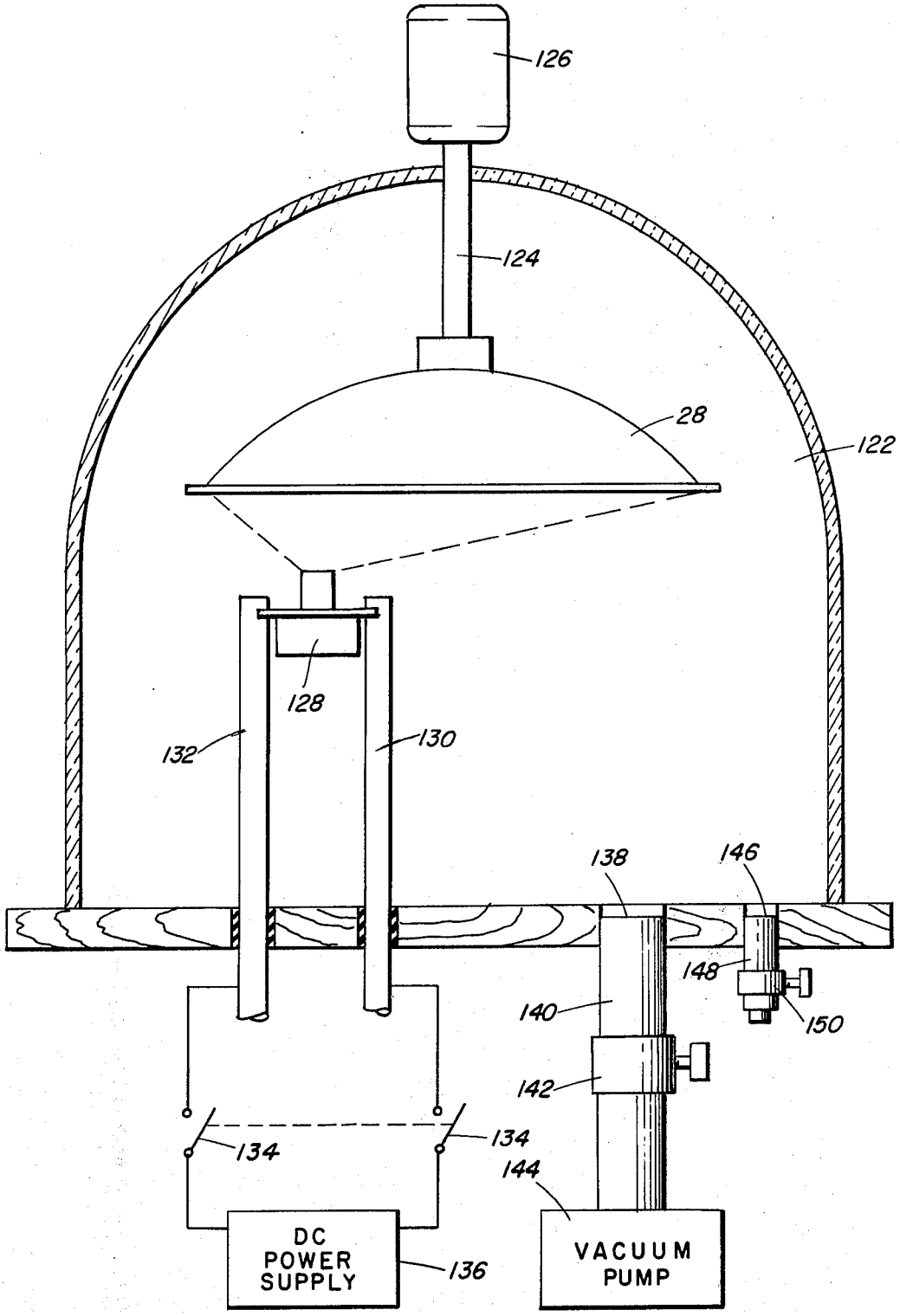
FIG. 4 is a schematic view of apparatus suitable for depositing the scintillator layer of the input screen shown in FIG. 1.

As shown in FIG. 4, in the processing of input screen 30, the substrate 28 initially may be supported within a bell jar enclosure 122 by having its convex surface suitably secured to one end of a rotatable shaft 124 which extends hermetically into the enclosure. Externally of enclosure 122, the shaft 124 is connected to a motor 126 which may be energized to rotate the shaft 124 about its axial centerline. Adjacent the outer periphery of substrate 28, an electrically conductive boat 128 having therein doped cesium iodide material is disposed to direct egressing gaseous vapor onto the concave surface of the substrate. The boat 128 is supported on a pair of suitably spaced, electrically conductive rods 130 and 132, respectively, which extend hermetically out of enclosure 122. Externally of the enclosure, the rods 130 and 132 are electrically connected through switch means 134 to respective terminals of a current source 136. The enclosure 122 is provided with an orifice 138 which communicates through a hermetically connected conduit 140 and a control valve 142 to vacuum pump means 144 for evacuating the enclosure. Also, the enclosure 122 is provided with an orifice 146 which communicates through a suitable conduit 148 to vent valve means 150 for connecting the enclosure to atmospheric pressure.

In operation, the control valve 142 is opened, and the vacuum pump means 144 is permitted to evacuate the enclosure 122 to a desired pressure, such as five millionths of a torr, for example. Then, the motor 126 is energized to rotate substrate 28 about its axial centerline; and the switch means 134 is closed to allow the current source 136 to heat the doped cesium iodide material in boat 128 to its vaporization temperature. As a result, the doped cesium iodide vapor egresses from the boat 128 and deposits on the concave surface of the relatively cooler substrate 28, whereby lateral migration of the deposited material is inhibited and longitudinal growth thereof substantially perpendicular to the substrate 28 is enhanced. Accordingly, the resulting scintillator layer 32 is comprised of juxtaposed crystalline rods which are microscopically spaced from one another to function as respective light pipes in promoting longitudinal transmission of fluoroescent light generated therein.

When the scintillator layer 32 has grown to a desired thickness, the switch means 134 is opened to disconnect the current source 136 from the boat 128, which then is allowed to cool to room temperature. The motor 136 also is denergized to stop the rotation of substrate 28. When the boat 128 has cooled to room temperature, the control valve 142 is closed, and the vent valve means 150 is opened to release the vacuum within enclosure 122. The substrate 28 then is removed from shaft 124 for assembly, as shown in FIG. 1, between the support annulus 22 and the ring 24. Thus, the collar 20 having attached thereto the input faceplate 14 and the input screen 30, minus photocathode layer 34, is slid into the cathode sleeve 42 which is hermetically attached to it, as described, to form the evacuable envelope 12.

Figure 5:
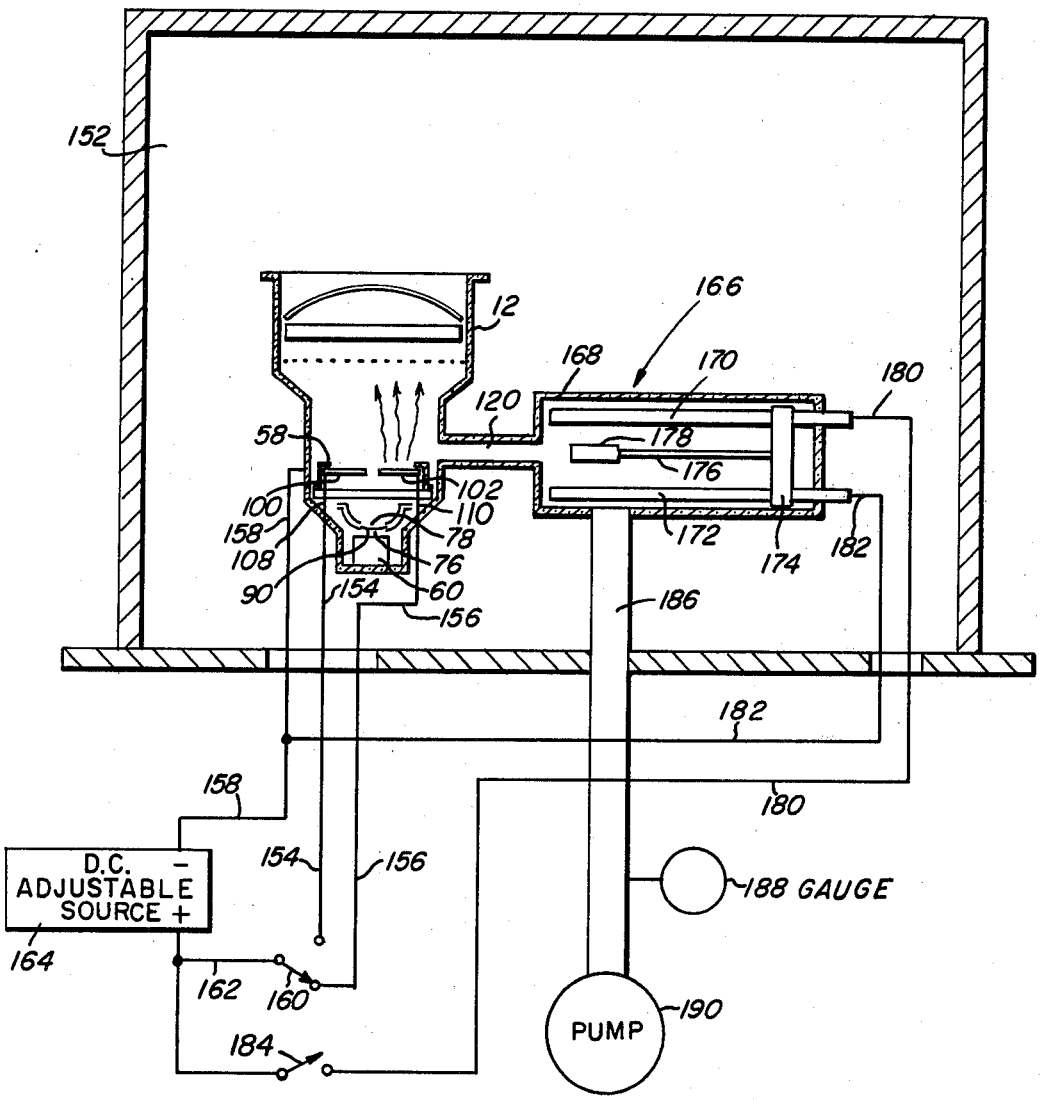
FIG. 5 is a schematic view showing the processing step of oxygenating the material of the scintillator layer prior to deposition of the photocathode layer.

As shown in FIG. 5, the tube, thus assembled and having the shutter disc 90 disposed between respective apertures 76 and 78 in third grid electrode 80, is mounted in an oven enclosure 152 for bake-out and evacuation of envelope 12. The dielectrically supported end portions of channel members 100 and 102 are connected electrically, by means of respective connected conductors 108 and 110 and the associated terminal buttons, to conductors 154 and 156, respectively, which extend out of oven enclosure 152. Similarly, the conductively supported end portions of channel members 100 and 102 are connected, in common, through the second grid electrode 58 to a conductor 158 which also extends out of oven enclosure 152. Externally of the oven enclosure, conductors 154 and 156 are connected to respective terminals of a switch 160, which has a movable arm connected to a conductor 162. The conductor 162 is connected to one terminal of an adjustable current source 164, which has another terminal connected to the conductor 158. Thus, by manipulation of switch 160, the source 162 may be connected to send a controllable electrical current through the channel member 100 or the channel member 102.

Also supported in oven enclosure 152 is an evaporator assembly 165 which communicates with the interior of envelope 12 through the exhaust tubulation 120. The evaporator assembly may comprise a tubular housing 158 made of nonmagnetic transparent material, such as glass, for example, and having one end hermetically attached to the exhaust tubulation 120. An opposing closed end of housing 168 supports externally protruding end portions of spaced parallel rails 170 and 172, respectively, which extend longitudinally within housing 168. The rails 170 and 172 have respective other end portions disposed adjacent the exhaust tubulation 120, and preferably are made of electrically conductive material, such as Kovar, for example. A transversely disposed plate 174 made of magnetic material, such as nickel, for example, is slidably movable, as by means of a magnet (not shown) disposed externally of housing 168, for example, along the rails 172 and 174, respectively, and supports a pair 176 of mutually insulated coaxial rods which extend axially in the direction of exhaust tubulation 120. The pair 176 of rods may be made of electrically conductive material, such as nickel, for example, and are electrically connected at a distal end portion thereof by an electrically conductive boat 178 having therein antimony liberating material, such as substantially pure antimony, for example, which is supported in alignment with exhaust tubulation 120.

The end portions of rails 170 and 172, respectively, protruding externally from the closed end of housing 168 are connected to respective conductors 180 and 182 which extend out of the oven enclosure 152. Externally of the oven enclosure, the conductor 180 is connected through a switch 184 to the conductor 162 and the respective terminal of current source 164; the conductor 182 is connected to conductor 158 and the respective terminal of source 164. Accordingly, when the switch 184 is closed, the source 164 sends an electrical current through the boat 176 to heat the antimony to a vaporization temperature. The housing 168 is connected through a conduit 186 to a vacuum gauge 188 and a vacuum pump 190 disposed externally of the oven enclosure 152. Thus, the conduit 186 and the pump 190 provide means for evacuating the housing 168 and the envelope 12 simultaneously.

In the phase of processing shown in FIG. 5, the oven enclosure 152 is heated to a suitable bake-out temperature, such as 300° C., for example, while the tube envelope 12 is being evacuated to a suitable pressure, such as $5\times10^{-7}$ torr, for example. The channel members 100 and 102 are outgassed by passing through them respective electrical currents, such as three amperes, for example, for a suitable interval of time, such as five minutes, for example. During outgassing, the channel members 100 and 102 release gaseous vapor of cesium and oxygen, respectively, which is indicated by the vacuum gauge 188 showing a noticeable increase in pressure. It has been found that the oxygen controllably liberated from the source 118 in channel member 102 migrates to the scintillator layer 32 and oxygenates or conditions the fluorescent material thereof. As a result, the subsequently deposited photoemissive material of photocathode layer 34 exhibits a substantial improvement, such as forty to fifty percent, for example, in photon-to-electrode conversion efficiency, and greater resolution than normally would be expected.

It may be theorized that the oxygen molecules adhere to the surface of the cesium iodide material or are trapped between the microscopically spaced rods of scintillator layer 32, and oxidize the subsequently deposited photoemissive material of photocathode layer 34. However, while the underlying reason for the substantial gain in conversion efficiency and resolving power is not completely understood, the resulting benefits derived from oxygenating the fluorescent material of scintillator layer 32 prior to deposition of the photocathode layer 34 are factual and very consistent. Accordingly, the input screen 30 having the oxygenated layer 32 of fluorescent material and the overlying layer 34 of photoemissive material provides greater conversion efficiency and higher resolving power than input screens of the prior art having an unoxygenated layer of fluorescent material and an overlying layer of photoemissive material.

As shown in FIG. 6, in a subsequent step of processing, the boat 178 having antimony material therein is moved axially through the exhaust tubulation 120 and into envelope 12. The respective switches 160 and 184 are activated to send vaporization electrical currents, such as five to six amperes, for example, through the channel member 100 and the boat 178. As a result, the combined vapors of cesium egressing from the channel member 100 and antimony migrating from the boat 178 deposit on the inner concave surface of scintillator layer 32 to form the photocathode layer 34. A standard light source 192 may be disposed to direct a beam of light through the portion of envelope 12 between the cathode support ring 24 and the axially spaced end of first grid electrode 54 to impinge on the inner surface of photocathode layer 34. Also, there may be electrically connected between the cathode flange 40 and the conductor 158, which is connected to second grid electrode 58, a microammeter 194 for measuring the electron current omitted by the photocathode layer 34. Preferably, the microammeter 194 is connected to a recorder 196 which shows successive peaks in the electron current as the photocathode layer 34 increases in thickness. When the electron current reaches a preselected peak, such as the first, second, or third, for example, the switches 160 and 184 are activated to stop the respective vaporization currents from flowing through the channel member 100 and the boat 178; and the boat 178 is withdrawn from envelope 12. After cooling to room temperature, the exhaust tubulation is sealed-off; and the tube 10 is removed from oven enclosure 152.

As shown in FIG. 7, the tube 10 subsequently is submitted to final test where the testing apparatus may be similar to the testing apparatus shown in FIG. 6. Thus, the standard light source 192 is disposed to direct a beam of light through the portion of envelope 12 between the cathode ring 24 and the adjacent end of first grid electrode 54. As a result, the beam of light impinges on the inner concave surface of photocathode layer 34 and causes it to emit an electron current. The channel member 102 having therein oxygen source 118 is connected electrically through conductor 156 to a respective terminal of switch 160, which has a movable arm connected electrically to conductor 162. The conductor 162 is connected electrically to a respective terminal of current source 164, which has another terminal connected through conductor 158 to second grid electrode 58 of tube 10. Connected electrically between conductor 158 and the cathode terminal 40 of tube 10 is a microammeter 194 which measures the electron current omitted from photocathode layer 34. Preferably, microammeter 194 is connected to recorder 196 which shows whether or not the photocathode layer 34 is achieving peak conversion efficiency.

If it should be found that the photocathode layer 34 is not attaining peak conversion efficiency, the switch 160 may be activated to connect the adjustable current source 164 to channel member 102. Consequently, a controlled current, such as five amperes, for example, may be sent through the channel member 102 to heat it to the desired temperature for vaporizing the material of oxygen source 118. As a result, gaseous oxygen vapor egressing from channel member 102 migrates to the input screen 30 and oxidizes the photoemissive material of photocathode layer 34. Since it is known that oxidizing photoemissive material enhances the photon-to-electron conversion efficiency thereof, the resulting improved gain should be readily noticeable on the recorder 196. When recorder 196 indicates that the peak conversion efficiency is reached, the switch 160 may be activated to cut off the current flowing through channel member 102. Thus, the tube 10 is provided with a sealed envelope 12 having therein controllable oxygen liberating means which may be activated to enhance the conversion efficiency of photocathode layer 34 when desired.

From the foregoing, it will be apparent that all of the objectives of this invention have been achieved by the structures and method described herein. It also will be apprent, however, that various changes may be made by those skilled in the art without departing from the spirit of the invention as expressed in the appended claims. It is to be understood, therefore, that all matter shown and described herein is to be interpreted as illustrative rather than in a restrictive sense.

What is claimed is:

1. A photosensitive screen comprising:

a substrate;

a layer of fluorescent material supported on the substrate and oxygenated with substantially pure oxygen; and a layer of photoemissive material disposed on the layer of oxygenated fluorescent material and in intimate contact with the oxygenated material thereof.

2. A photosensitive screen as set forth in claim 1 wherein the layer of oxygenated fluorescent material comprises a doped alkali-halide material.

3. A photosensitive screen as set forth in claim 2 wherein the alkali-halide material is cesium iodide.

4. A photosensitive screen as set forth in claim 2 wherein the doped alkali-halide material comprises an array of juxtaposed crystalline rods spaced from one another and disposed substantially perpendicular to the substrate.

5. A light amplifier tube comprising:

an evacuated envelope having a radiation transmissive input portion and a light transmissive output portion;

an input screen supported within the envelope in alignment with the input portion of the envelope, the input screen including a scintillator layer of fluorescent material oxygenated with substantially pure oxygen and an overlying photocathode layer of photoemissive material disposed in direct contact with the oxygenated material thereof; and an output screen disposed within the envelope in spaced opposing relationship with the photocathode layer and adjacent the output portion of the envelope.

6. A light amplifier tube as set forth in claim 5 wherein the photocathode layer includes oxidized photoemissive material.

7. An image intensifier tube comprising:

a sealed envelope having a radiation transmissive input portion and a light transmissive output portion;

an input screen supported within the envelope in alignment with the input portion of the envelope, the input screen including a scintillator layer of fluorescent material oxygenated with substantially pure oxygen and having disposed in intimate contact therewith an overlying photocathode layer of photoemissive material.

8. An image intensifier tube as set forth in claim 7 wherein the photoemissive material of the photocathode layer is oxidized.

* * * * *